US007371167B2

(12) United States Patent
Dayan

(10) Patent No.: US 7,371,167 B2
(45) Date of Patent: May 13, 2008

(54) DETERMINING A RESULT OF AN ELECTRONIC GAME

(75) Inventor: Marcel Dayan, Brighton (AU)

(73) Assignee: Tabcorp International Pty Ltd, Melbourne, Vic (AU)

( * ) Notice: Subject to any disclaimer, the term of this patent is extended or adjusted under 35 U.S.C. 154(b) by 900 days.

(21) Appl. No.: 10/725,580

(22) Filed: Dec. 3, 2003

(65) Prior Publication Data

US 2004/0110553 A1 Jun. 10, 2004

(30) Foreign Application Priority Data

Dec. 4, 2002 (AU) ..... 2002953092

(51) Int. Cl.
*A63F 3/06* (2006.01)

(52) U.S. Cl. ..... 463/16; 463/25; 273/269

(58) Field of Classification Search ..... None
See application file for complete search history.

(56) References Cited

U.S. PATENT DOCUMENTS 3,560,127 A * 2/1971 Imperato ..... 273/246
5,938,200 A * 8/1999 Markowicz et al. ..... 273/246

OTHER PUBLICATIONS

Powerball, webpage (http://en.wikipedia.org/wiki/Powerball), 6 pages, downloaded Jul. 2007.*
Mega Millions, webpage (http://en.wikipedia.org/wiki/Mega_Millions), 5 pages, downloaded Jul. 2007.*

* cited by examiner

*Primary Examiner*—M. A Sager
(74) *Attorney, Agent, or Firm*—Miles & Stockbridge P.C.

(57) ABSTRACT

There is disclosed a method of determining a result of an electronic game in order to allow fixed odds betting on the result. The method comprises providing a mechanical ball draw machine (3) configured to draw one ball at a time from a set of balls also provided to said mechanical ball machine (3). The set of balls consists of a plurality of subsets of one or more balls, at least some of the subsets having different numbers of balls and each ball being identifiable as belonging to a subset, whereby the relative numbers of balls in the subsets determine the likelihood of a ball from a subset being drawn thus allowing fixed odds betting to be carried out on a result is determined on the basis of subset identity. The method further comprises drawing a ball or balls using the mechanical ball machine (3) until sufficient balls have been drawn to enable a result to be determined, identifying the subset to which each said ball or balls belongs, and determining the result of the electronic game from the identified subset or subsets.

16 Claims, 3 Drawing Sheets

DETERMINING A RESULT OF AN ELECTRONIC GAME

FIELD OF THE INVENTION

The present invention relates to a method and apparatus for determining a result of an electronic game in order to allow fixed odds betting on the result.

BACKGROUND TO THE INVENTION

We have previously developed an electronic game which allows fixed odds betting on the outcome of the game.

The game is a race and players can bet on the participants in the race. The race is typically a simulated horse race and players bet on the simulated horses. To provide a variety of different bets, different probabilities of winning are allocated to horses. A random number generator is used to determine the outcome. Typically, the random number generator produces a value between zero and one, and portions of the range (eg. 0.01-0.20, 0.21-0.35, etc) are assigned to different horses. Thus, the fixed odds which are offered to players of the game are based on the relative chances of electronic horses winning the electronic horse race. To determine the winning horse, the random number generator is run and the value is compared to the allocated portions of the range to determine which horse will win.

In order to allow betting on the second and third placed horses, the game engine is configured to determine second and third positions. To do so, the game engine is configured to re-adjust the portions of the range of possible random number generator values which are allocated to individual horses after each horse is drawn because the horse that filled the previous place should not be selected again. This involves proportionately redistributing the portions of selected horses to the remaining horses.

Once the results have been determined, the game engine simulates an electronic horse race in which the horses determined using the random number generator to finish in first, second and third positions finish in this order in a simulated race conducted over, for example, 30 seconds.

While this game has proved popular and effective in its current form, we have subsequently realised that the mechanism which is used to determine the result, (ie, the random number generator), is either not an allowable mechanism in some jurisdictions or causes the game to be subject to a more complicated (and hence, costly) regulatory scheme.

At the same time, we have determined that such jurisdictions often have less strict regulation of games which use mechanical ball draw machines as these games are considered to be less susceptible to tampering. Hitherto, mechanical ball draw machines have been used to draw numbers from a set of numbers where all the numbers are different in order to determine a result of a game where the result is solely related to the numbers which are drawn.

The present invention utilises a novelly configured mechanical ball draw device in order to allow fixed odds betting on an electronic game.

SUMMARY OF THE INVENTION

The invention provides apparatus for determining a result of an electronic game in order to allow fixed odds betting on the result, the apparatus having:

a mechanical ball draw machine configured to draw one ball at a time from a set of balls;

a set of balls to be used by said mechanical ball machine, the set of balls consisting of a plurality of subsets of one or more balls, at least some of the subsets having different numbers of balls, each ball being identifiable as belonging to a subset, whereby the relative numbers of balls in the subsets determine the likelihood of a ball from a subset being drawn thus allowing fixed odds betting to be carried out on a result determined on the basis of subset identity; and a game controlling device configured to control said ball machine to draw a ball or balls until sufficient balls have been drawn to enable a result to be determined, to identify the subset to which each said ball or balls belongs, and to determine the result of said electronic game from the identified subset or subsets.

In one embodiment said game controlling device controls said ball machine to draw a single ball whereby a single subset is identified.

In one embodiment said game controlling device controls said ball machine to draw a plurality of balls whereby a plurality of different subsets are identified and the game controlling device determines the result on the basis of the order in which the balls corresponding to the subset are drawn.

In one embodiment said game controlling device controls said ball machine to draw balls are drawn until three different subsets are identified.

In one embodiment said electronic game involves a race having a plurality of participants each of which are allocated one of said subsets of balls, and wherein determination of the result by said game controlling device involves allocating first position in the race to the participant corresponding to the first subset identified.

In one embodiment said electronic game involves a race having a plurality of participants each of which are allocated one of said subsets of balls, and wherein determination of the result by said game controlling device involves allocating first position in the race to the participant corresponding to the first subset identified, second position to the participant corresponding to the second subset which is identified, and third position to the third participant corresponding to the third subset which is identified.

In one embodiment said apparatus comprises an additional mechanical ball machines so that there is a primary mechanical ball machine and a secondary mechanical ball machine, and drawing from both mechanical ball machines substantially simultaneously and wherein the game controlling device uses the subsets identified from said primary mechanical ball machine to determine the result unless the primary mechanical ball machine fails and wherein the game controlling device uses the subsets identified from said secondary mechanical ball machine to determine the result if the primary mechanical ball machine fails.

In another embodiment said apparatus comprises at least one additional mechanical ball machine so that there are a plurality of mechanical ball machines, drawing from each of the plurality of mechanical ball machines substantially simultaneously and wherein said game controlling device uses the subsets identified by whichever mechanical ball machine first produces the required number of different subset identities to determine the result.

The invention also provides a method of determining a result of an electronic game in order to allow fixed odds betting on the result, the method comprising:

providing a mechanical ball draw machine configured to draw one ball at a time from a set of balls;

providing a set of balls to said mechanical ball machine, said set of balls consisting of a plurality of subsets of one or more balls, at least some of the subsets having different numbers of balls and each ball being identifiable as belonging to a subset, whereby the relative numbers of balls in the subsets determine the likelihood of a ball from a subset being drawn thus allowing fixed odds betting to be carried out on a result determined on the basis of subset identity; and drawing a ball or balls using said mechanical ball machine until sufficient balls have been drawn to enable a result to be determined;

identifying the subset to which each said ball or balls belongs; and determining the result of said electronic game from the identified subset or subsets.

BRIEF DESCRIPTION OF THE DRAWINGS

A preferred embodiment of the invention will now be described in relation to the accompanying drawings in which.

DESCRIPTION OF THE PREFERRED EMBODIMENT

Figure 1:
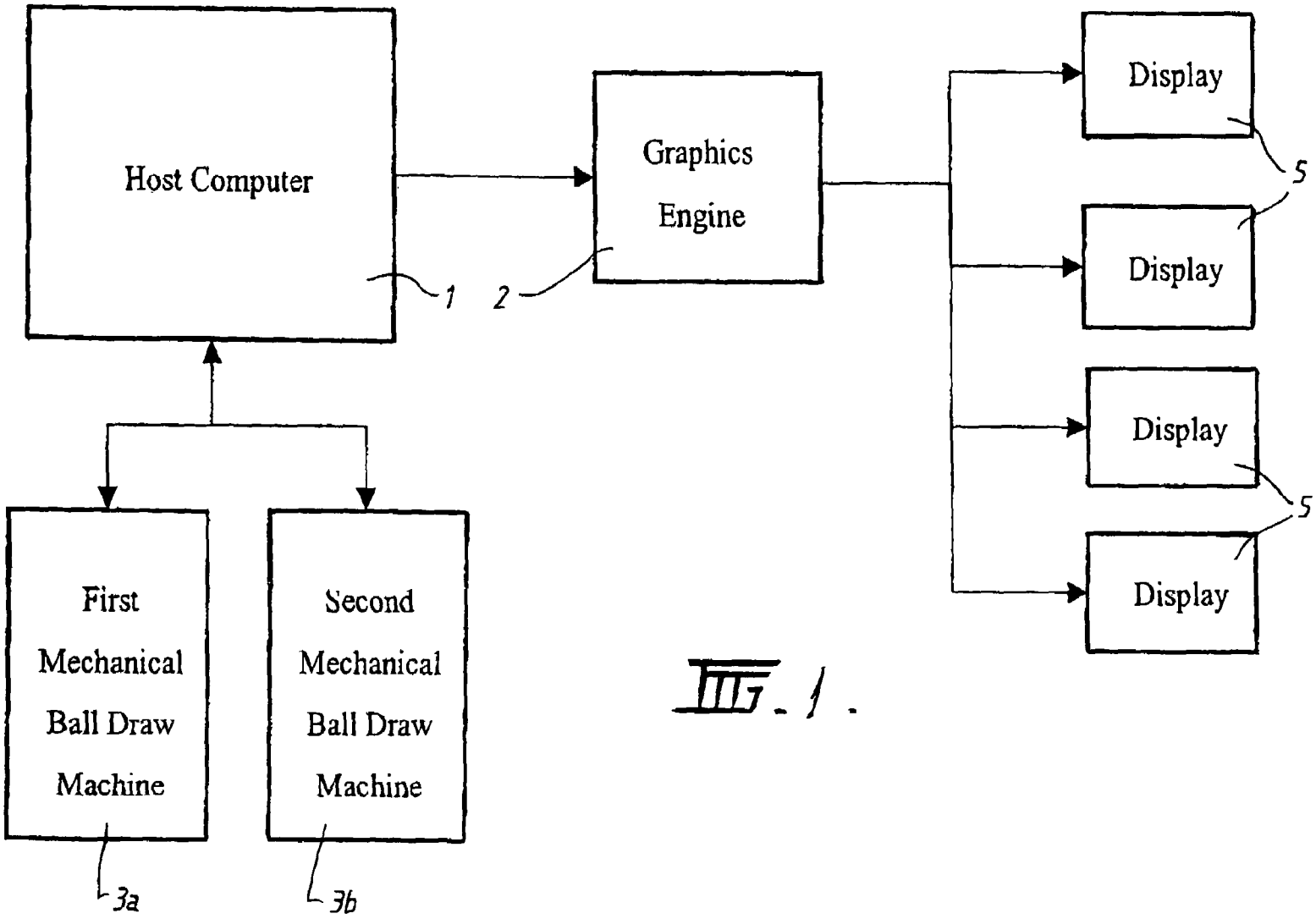
FIG. 1 is a schematic diagram of the system of the preferred embodiment.
Figure 2:
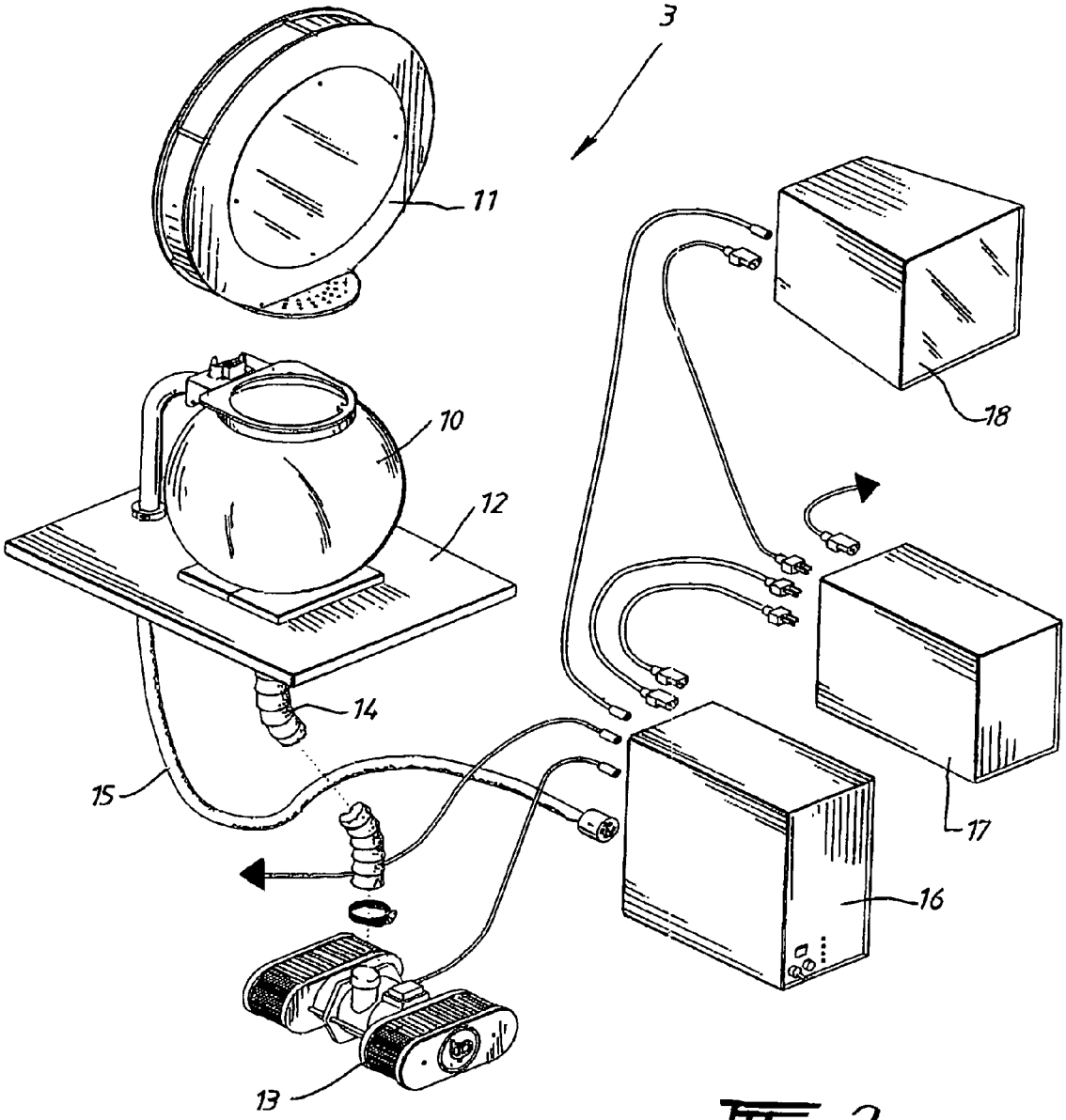
FIG. 2 shows a mechanical ball draw machine apparatus suitable for use in the preferred embodiment.

FIG. 1 is a schematic diagram of the apparatus for determining the result of an electronic game of the preferred embodiment. In the preferred embodiment, the electronic game is a harness horse racing game where players bet or wager on the result of the electronic game. The individual horses in the electronic game provide a plurality of participants which can be bet upon. Players of the game can place fixed odds bets on the horses in the same manner as fixed odds bets can be placed on conventional horse races. To stimulate customer interest in such a game, it is necessary to allow players to bet at a variety of different odds.

In the preferred embodiment, the electronic game is controlled by software running on a host computer 1 which provides a game controlling device for determining the result of the game.

To obtain the result in a manner which allows fixed odds betting, the host computer 1 is connected to two mechanical ball draw machines 3*a*, 3*b*. The second mechanical ball draw machine 3*b* acts as a back up to the first mechanical ball draw machine 3*a*, should there be a failure of the first ball draw machine 3*a*.

Figure 3:
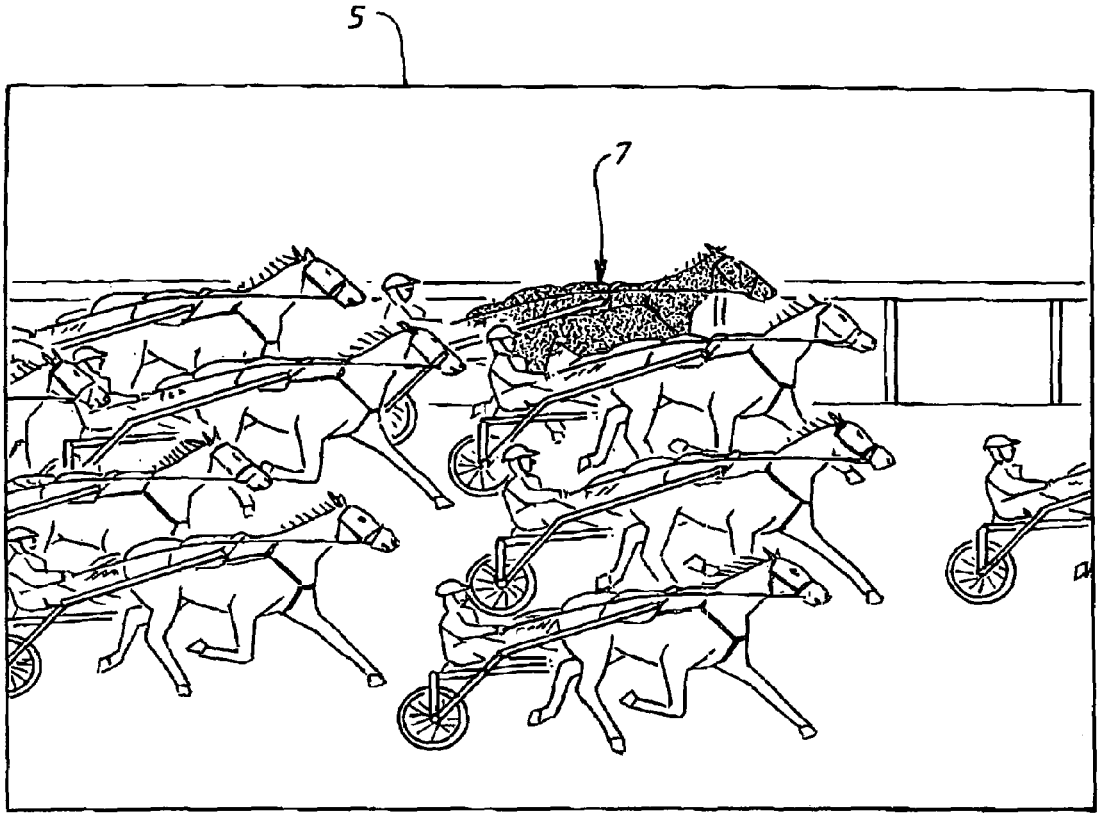
FIG. 3 is a screen shot of an electronic game the preferred embodiment.

An exemplary construction of a ball draw machine 3 is indicated in FIG. 3. Each ball draw machine 3 consists of glass bowl 10 mounted on a base 12. A blower 13 is connected by tube 14 to a hole in the bottom of the glass bowl 10. When actuated, the blower 13 blows balls contained within the glass bowl until one is received within the ball display unit 11 which is configured to identify a ball as it is blown into a holding position and then to rotate in order to receive a further ball. Operation of the mechanical ball draw machine is under control of control unit 16. The control unit 16 actuates the blower 13 when necessary and also causes the ball display unit 11 to rotate. The control unit 16 also receives signals via cable 15 advising it of the identity of the balls drawn by the ball display unit 11. The control unit is in communication with, and is itself controlled by, the host computer 1.

In the preferred embodiment, each of the balls has a barcode on it which allows the ball to be read by the ball display unit 11.

The ball machine apparatus also includes a universal power supply 17 for ensuring the ball machine does not fail and a monitor 18 connected to a camera mounted in the ball display unit which allows visual confirmation of the ball identified by the ball display unit 11.

In the preferred embodiment, there are 12 different participants in the horse race. To provide different odds for the different horses, a set of balls is used in the mechanical ball draw machine which consists of a plurality of subsets of balls of different numbers. Each subset is associated with one of the horses. All of the numbers in each subset of balls are identifiable as belonging to a particular subset. Accordingly, when a ball is drawn the identity of the subset to which it belongs can be used to determine the horse and hence at least part of the result. For example, all of the balls belonging to horse number one are numbered with the numeral one. It will be appreciated that a number of techniques can be used to allocate the ball to a particular subset.

We have found for a 12 participant horse race, a particularly suitable distribution of balls is shown in Table 1.

TABLE 1

SET HOUSE RETURN = 20.00%

| HORSE NUMBER | Number of Balls | BETTING MARKET | Actual WIN ODDS | Calculated WIN 1% | WIN 10% | Actual Pay | Actual House Return | Input WIN ODDS | Zero Return |
|---|---|---|---|---|---|---|---|---|---|
| 1 | 20 | 25.00% | 3.00 | $4.00 | $4.00 | $4.00 | 20.00% | 3.00 | $5.00 |
| 2 | 15 | 18.75% | 4.33 | $5.33 | $5.30 | $5.25 | 21.25% | 4.25 | $6.67 |
| 3 | 11 | 13.75% | 6.27 | $7.27 | $7.30 | $7.25 | 20.25% | 6.25 | $9.09 |
| 4 | 10 | 12.50% | 7.00 | $8.00 | $8.00 | $8.00 | 20.00% | 7.00 | $10.00 |
| 5 | 9 | 11.25% | 7.89 | $8.89 | $8.90 | $9.00 | 19.00% | 8.00 | $11.11 |
| 6 | 8 | 10.00% | 9.00 | $10.00 | $10.00 | $10.00 | 20.00% | 9.00 | $12.50 |
| 7 | 7 | 8.75% | 10.43 | $11.43 | $11.40 | $11.50 | 19.50% | 10.50 | $14.29 |
| 8 | 6 | 7.50% | 12.33 | $13.33 | $13.30 | $13.25 | 20.50% | 12.25 | $16.67 |
| 9 | 5 | 6.25% | 15.00 | $16.00 | $16.00 | $16.00 | 20.00% | 15.00 | $20.00 |
| 10 | 4 | 5.00% | 19.00 | $20.00 | $20.00 | $20.00 | 20.00% | 19.00 | $25.00 |
| 11 | 3 | 3.75% | 25.67 | $26.67 | $26.70 | $26.50 | 20.50% | 25.50 | $33.33 |
| 12 | 2 | 2.50% | 39.00 | $40.00 | $40.00 | $40.00 | 20.00% | 39.00 | $50.00 |
| | 100 | 125.00% | | | | | | | |

In Table 1, the house return is intended to be 20%. Accordingly, a betting market is set at 125% and distributed amongst a number of horses. The distribution of the greater numbers of balls for horse number 1 (ie, twenty balls) means that this horse has a much greater chance of winning than, for example, horse number 8 which has only six balls of the 100 balls in the ball machine 3.

Persons skilled in the art will appreciate that using the actual win odds will not always be practical because they will require payouts of very small denomination coins. Accordingly, slight variations on these odds are used. For example, the set of odds shown in the right hand column of Table 1 presume that 5 cent pieces will be available as a reasonably convenient form of payment. Accordingly, the actual payment odds give slight variations compared to the absolute odds which lead to slight variations in the house return. The variations in the house return are sufficiently small as to have a barely noticeable effect on the outcome of betting on individual horses.

When it is desired to determine the outcome of the game, the ball draw machine 3 is started and balls are drawn. The subset identity of each drawn ball is provided to the control unit which in turn provides it to the host computer 1 which in order to allow it to determine the result of a game.

In a typical horse racing electronic game, the result will include the first three horses in order to allow players to bet on the first, second and third positions as well as combinations of these positions.

Persons skilled in the art will appreciate that it is possible, indeed quite likely for repeat balls to be drawn belonging to a particular horse before obtaining three discrete or different horses from the ball draw machine. In the preferred embodiment, balls relating to horses which have already been drawn are discarded and the result is determined by the first three different horses which are identified.

Theoretically, with the ball distribution of Table 1, thirty six balls might be drawn before a result was reached. However, it is important, that the result be reached quickly so that the game appears to players to be proceeding at a normal rate. Any stalling in the process is likely to reduce players' confidence in the game. We have determined that the probability of the result being drawn in three balls using the ball distribution of Table 1 is 71.4%. The probability of the result being reached inside four balls is 92.7% and the probability of a result being achieved in five balls is 98.2%.

The selling of the game, typically ends 15 seconds before the electronic race begins. This period is filled by a simulation of the events preceding the race, for example, the horses walking around a mounting yard and being loaded into a starters barrier. To account for situations where it is necessary to draw a larger number of balls in order to obtain a result, the preferred embodiment provides a wait sequence which gives the host computer an extra 10 seconds to arrive at a result.

Once the result of the game has been determined, the host computer 1 instructs the graphics engine 2 to create the horse race simulation. The graphics engine 2 then causes the simulated horse race to be displayed on displays 5. In the example of FIG. 3, the horse determined to win the race 7 which is shown to be trailing the leader, will be caused to move ahead in such a manner that when it crosses the line in front.

In a further improvement on the preferred embodiment, the first and second ball machines are used to draw balls simultaneously and the machine which first produces three different balls is used to provide the results. This increases the rate at which the result is reached. For example, it increases the probability of a result being achieved within three balls to 91.8%.

These and other modifications will be apparent to persons skilled in the art and are considered as falling within the scope of the invention described herein. For example, the number of balls in the ball machine may be varied.

The invention claimed is:

1. A method of determining a result of an electronic game in order to allow fixed odds betting on the result, the method comprising: providing a mechanical ball draw machine configured to draw one ball at a time from a set of balls; providing a set of balls to said mechanical ball machine, said set of balls consisting of a plurality of subsets of one or more balls, at least some of the subsets having different numbers of balls and each ball being identifiable as belonging to a subset, whereby the relative numbers of balls in the subsets determine the likelihood of a ball from a subset being drawn thus allowing fixed odds betting to be carried out on a result determined on the basis of subset identity; drawing a ball or balls using said mechanical ball machine until sufficient balls have been drawn to enable a result to be determined; identifying the subset to which each said ball or balls belongs; and determining the result of said electronic game from the identified subset or subsets.

2. A method am claimed in claim 1, wherein a single ball is drawn and a single subset is identified.

3. A method as claimed in claim 1, wherein a plurality of balls are drawn and a plurality of subsets are identified and the game result is also determined on the basis of the order in which the balls corresponding to the subset are drawn.

4. A method as claimed in claim 3, wherein balls are drawn until three different subsets are identified.

5. A method as claimed in claim 1, wherein said electronic game involves a race having a plurality of participants each of which are allocated one of said subsets of balls, and wherein determining the result involves allocating first position in the race to the participant corresponding to the first subset identified.

6. A method as claimed in claim 4, wherein said electronic game involves a race having a plurality of participants each of which are allocated one of said subsets of balls, and wherein determining the result involves allocating first position in the race to the participant corresponding to the first subset identified, second position to the participant corresponding to the second subset which is identified, and third position to the third participant corresponding to the third subset which is identified.

7. A method as claimed in claim 1, comprising providing an additional mechanical ball machines so that there is a primary mechanical ball machine and a secondary mechanical ball machine, and drawing from both mechanical ball machines substantially simultaneously and using the subsets identified from said primary mechanical ball machine to determine the result unless the primary mechanical ball machine fails and using the subsets identified from said secondary mechanical ball machine to determine the result if the primary mechanical ball machine fails.

8. A method as claimed in claim 3, comprising providing at least one additional mechanical ball machine so that there are a plurality of mechanical ball machines, drawing from each of the plurality of mechanical ball machines substantially simultaneously and using the subsets identified by whichever mechanical ball machine first produces the required number of different subset identities to determine the result.

9. Apparatus for determining a result of an electronic game in order to allow fixed odds betting on the result, the apparatus having: a mechanical ball draw machine configured to draw one ball at a time from a set of balls; a set of balls to be used by said mechanical ball machine, the set of balls consisting of a plurality of subsets of one or more balls, at least some of the subsets having different numbers of balls, each ball being identifiable as belonging to a subset, whereby the relative numbers of balls in the subsets determine the likelihood of a ball from a subset being drawn thus allowing fixed odds betting to be carried out on a result determined on the basis of subset identity; and a game controlling device configured to control said ball machine to draw a ball or balls until sufficient balls have been drawn to enable a result to be determined, to identify the subset to which each said ball or balls belongs, and to determine the result of said electronic game from the identified subset or subsets.

10. Apparatus as claimed in claim 9, wherein said game controlling device controls said ball machine to draw a single ball whereby a single subset is identified.

11. Apparatus as claimed in claim 9, wherein said game controlling device controls said ball machine to draw a plurality of balls whereby a plurality of different subsets are identified and the game controlling device determines the result on the basis of the order in which the balls corresponding to the subset are drawn.

12. Apparatus as claimed in claim 11, wherein said game controlling device controls said ball machine to draw balls are drawn until three different subsets are identified.

13. Apparatus as claimed in claim 9, wherein said electronic game involves a race having a plurality of participants each of which are allocated one of said subsets of balls, and wherein determination of the result by said game controlling device involves allocating first position in the race to the participant corresponding to the first subset identified.

14. Apparatus as claimed in claim 12, wherein said electronic game involves a race having a plurality of participants each of which are allocated one of said subsets of balls, and wherein determination of the result by said game controlling device involves allocating first position in the race to the participant corresponding to the first subset identified, second position to the participant corresponding to the second subset which is identified, and third position to the third participant corresponding to the third subset which is identified.

15. Apparatus as claimed in claim 9, comprising an additional mechanical ball machines so that there is a primary mechanical ball machine and a secondary mechanical ball machine, and drawing from both mechanical ball machines substantially simultaneously and wherein the game controlling device uses the subsets identified from said primary mechanical ball machine to determine the result unless the primary mechanical ball machine fails and wherein the game controlling device uses the subsets identified from said secondary mechanical ball machine to determine the result if the primary mechanical ball machine fails.

16. Apparatus as claimed in claim 11, comprising at least one additional mechanical ball machine so that there are a plurality of mechanical ball machines, drawing from each of the plurality of mechanical ball machines substantially simultaneously and wherein said game controlling device uses the subsets identified by whichever mechanical ball machine first produces the required number of different subset identities to determine the result.

* * * * *

UNITED STATES PATENT AND TRADEMARK OFFICE

CERTIFICATE OF CORRECTION

PATENT NO. : 7,371,167 B2
APPLICATION NO. : 10/725580
DATED : May 13, 2008
INVENTOR(S) : Marcel Dayan It is certified that error appears in the above-identified patent and that said Letters Patent is hereby corrected as shown below:

Column 6, Line 27 Claim 2 – Delete "am" and replace with --as--

Signed and Sealed this

Twelfth Day of August, 2008

JON W. DUDAS
*Director of the United States Patent and Trademark Office*